US005317973A

United States Patent [19]

Winaver, deceased et al.

[11] Patent Number: 5,317,973

[45] Date of Patent: Jun. 7, 1994

[54] DETONATING DEVICE FOR A SECONDARY EXPLOSIVE CHARGE

[75] Inventors: André Winaver, deceased, late of Paris, France; Dominique Broussoux, Orleans, France

[73] Assignee: Thomson-Brandt Armements, St. Aubin, France

[21] Appl. No.: 957,775

[22] Filed: Oct. 8, 1992

[30] Foreign Application Priority Data

Oct. 11, 1991 [FR] France ..... 91 12566

[51] Int. Cl.[5] ..... F42C 19/08; F42C 19/12

[52] U.S. Cl. ..... 102/201

[58] Field of Search ..... 102/201

[56] References Cited

U.S. PATENT DOCUMENTS 4,700,629 10/1987 Benson et al. ..... 102/201
4,843,964 7/1989 Bickes, Jr. et al. ..... 102/202.5
4,862,802 9/1989 Streifer et al. ..... 102/201
5,005,462 4/1991 Jasper, Jr. et al. ..... 89/8

FOREIGN PATENT DOCUMENTS 0394562 10/1990 European Pat. Off. .
0396465 11/1990 European Pat. Off. .
1578436 12/1970 Fed. Rep. of Germany .
2545600 11/1984 France .

*Primary Examiner*—Daniel T. Pihulic
*Attorney, Agent, or Firm*—Oblon, Spivak, McClelland, Maier & Neustadt

[57] ABSTRACT

The detonating device for a secondary explosive charge includes energy reservoir means and exploding foil igniter means coupled to the energy reservoir means by an optical commutator functioning in photo-conduction mode. The device may be extended to any number of separate detonation channels, and each detonation channel may be supplied with optical pulse beams generated by a single laser source or by separate, dedicated laser sources. The optical pulse beams are guided via optical fibers that may vary in length in accordance with preprogrammed detonation timing sequences. The invention finds particular application in the field of high safety detonation systems.

8 Claims, 6 Drawing Sheets

DETONATING DEVICE FOR A SECONDARY EXPLOSIVE CHARGE

BACKGROUND OF THE INVENTION

The present invention concerns a detonating device for a secondary explosive charge. It applies notably to high-safety detonation systems including one or more exploding foil igniters used to detonate secondary explosive charges, such as hollow charges, slug- or fragment-generating charges, for example, quasi-simultaneously or respecting a precise timing sequence, which may either be pre-established or programmed during the mission depending on the target to be destroyed.

According to the present state of the art, a high-safety detonating system generally comprises an energy reservoir, an energy commutator, switching control and verification circuits and a detonator. In order to function properly, high-safety detonators require the switching of energies of a few hundred millijoules, even one joule, in a few tens of nanoseconds. In the electric circuits this switching implies currents of several kilo-amperes and applied voltages of several kilo-volts. The switching device in use at present is a gas or vacuum discharger. It allows the flow of several kilo-amperes under several kilo-volts when it is in closed mode, but the changeover from open mode to closed mode involves a switching time which is too long for certain applications. The changeover from open mode to closed mode is made by the activation of a third electrode called the "trigger" and under high voltage, 3 to 4 KV for example. This trigger provokes a disruptive discharge between the main electrodes of the discharger, accompanied by interference due to the phenomenon known as "jitters". These "jitters" delay the establishment of the closed mode and provoke switching times generally longer than 100 ns. The times obtained with gas or vacuum dischargers and the jitter phenomenon are incompatible with sequenced or synchronized multipoint initiation systems which require perfect control of the timing and the jitters, and also switching times of the order of a few nanoseconds.

In order to improve the timing precision between the different detonations, and in fact reduce the switching times, one solution consists in using the optical energy of a pulsed laser to trigger the energy switching through the discharger. This method of triggering has been widely described in the following publications: V. A. VUYLSTEKI JAP 34, 1615 (1963), L. L. STEINMETZ, The Review of Scientific Instrument, 39, n°6 (1968), pages 904/909, H. C. HARGES Texas University Report n°LLL 2257509-1 (1979), R. A. DOUGAL et al., J. Phys D.Appli. Phy., 17 (1984), pages 903/918.

The main drawback of the discharger triggered by an optical pulse is that it requires a high power pulsed laser, for example between 100 kW and 1 MW corresponding to energies of between 1 and 10 millijoules transmitted in approximately 10 ns, each discharger having an associated laser which is specific to it.

Today, the most compact laser sources known, whose volumes are of a few tens of cubic centimeters, limit the functioning ranges to a frequency of around 1 kHz and so do not allow rapid sequenced triggering, for example sequences with 100 ns between each pulse. What is more, the powers used for triggering dischargers, notably those of more than 100 kW, impose the use of special wide optical fibers for certain system structures, which are fragile and difficult to use due to the limited curvature they can tolerate without breaking.

SUMMARY OF THE INVENTION

The purpose of the invention is to overcome the above-mentioned difficulties.

The invention concerns a detonating device for a secondary explosive charge including at least one energy reservoir coupled via an energy switching element to an exploding foil igniter detonator wherein the energy switching element is made up of a semiconductor-based electronic commutator.

The main advantages of the invention are that it requires only a small triggering energy, typically a few micro-joules, that it allows short detonation delays, typically of less than 1 ns, due most notably to the elimination of the jitter phenomenon, that it protects the detonations from electromagnetic radiation, and finally that it provides for both compact detonation means and greater ease of use.

BRIEF DESCRIPTION OF THE DRAWINGS

Other characteristics and advantages of the invention will appear on reading the description below which refers to the annexed drawings which represent.

DESCRIPTION OF THE INVENTION

Figure 1A:
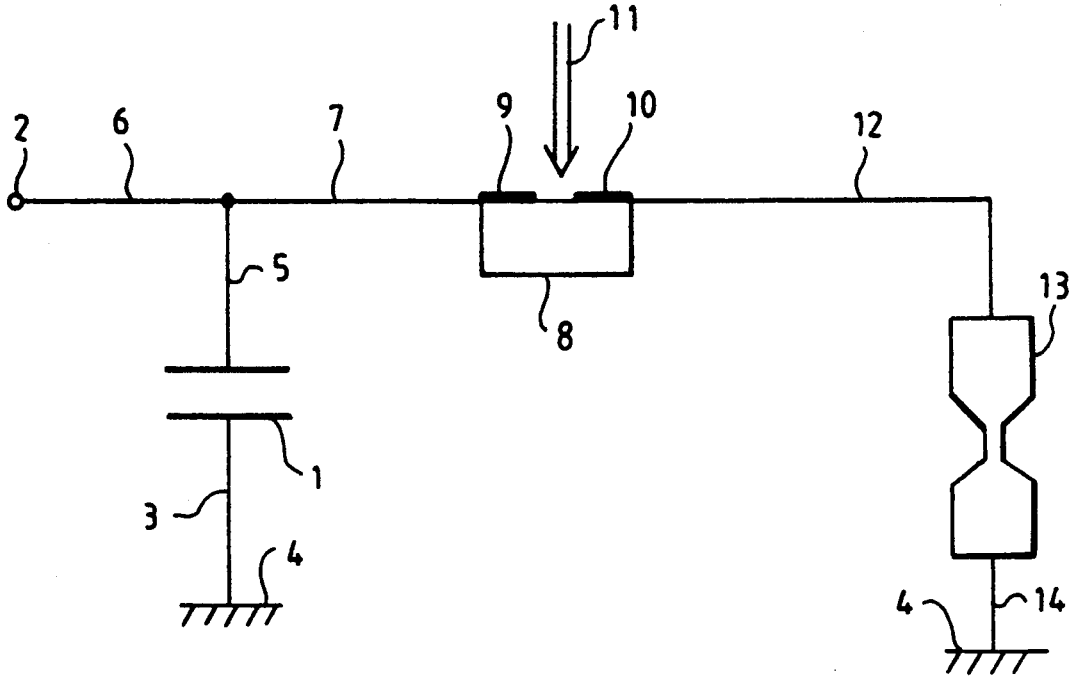
FIG. 1*a*: An elementary detonating device according to the invention.

FIG. 1*a* presents an elementary detonating device according to the invention. It includes an electrical energy reservoir 1, a capacitor for example, charged under several kilo-volts, of capacity between 0.1 and 0.2 μF, having one electrode connected via a line 3 to a reference potential 4. Its other electrode is connected to an input 2 for its charging current via lines 5 and 6 and also, via lines 5 and 7, to an electrode 9 of an electronic energy commutator 8, semiconductor-based (gallium arsenide for example) and operating in photo-conduction mode for example. The other electrode 10 of the commutator 8 is connected to the terminal of a flyer detonator 13 via line 12. The other terminal of the detonator 13 is linked to the reference potential 4 via line 14. The lines 3,5,7,12 and 14 can be, for example, in the form of flat conductors so as to reduce the parasitic self-inductance and thus reduce parasitic voltages on the terminals of the commutator 8. The closing switching, which triggers the liberation of the energy, is controlled by a low-level optical pulse 11. The commutator 8 can switch currents of several kilo-amperes under a voltage of several kilo-volts at its terminals. The optical energy required to activate the commutator 8 is very low, approximately 100 μJ for example, because the presence of the optical pulse is not necessary for the whole time of the energy switching through the commutator, so for a switching time of approximately 100 ns an optical pulse of approximately 10 ns is sufficient to trigger the closing of the commutator. Once the optical pulse 11 disappears, the commutator remains closed until the current crossing it has disappeared, i.e. until the energy reservoir 1 has totally discharged. This property of the optical commutator allows, for example, the use of laser diodes as the optical source, capable of delivering optical power of approximately 1 kW for 10 ns, for example. It is also possible to envisage a triggering of the commutator 8 by a signal which is not optical, for example a low energy electrical signal.

Figure 1B:
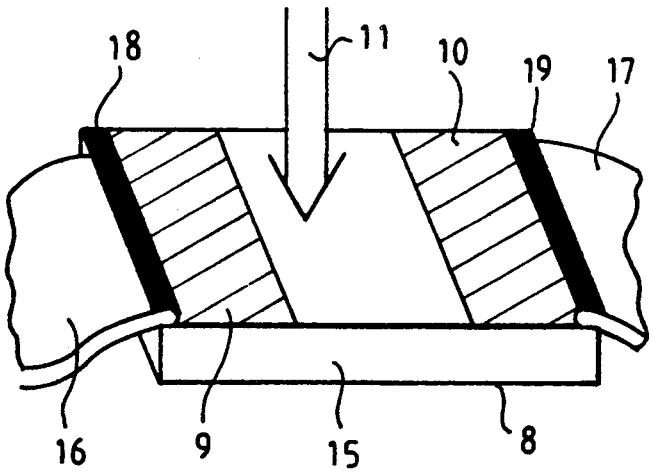
FIG. 1*b*: An example of the structure of an energy commutator.

FIG. 1*b* shows an example of the structure of the gallium arsenide commutator 8 used in the detonation device according to the invention. It is made up of a gallium arsenide semiconductor substrate 15 of approximate resistivity $10^7$ W.cm, of approximate thickness 1 mm and width 1 cm onto which are placed two electrodes 9 and 10 made up, for example, of four successive layers of metal: 50 Å of nickel, 750 Å of gold, 750 Å of nickel and 2000 Å of gold so as to create ohmic contacts between the metal and the gallium arsenide and to provide a space between the electrodes to enable a voltage to be applied to the terminals of the circuit, for example 1 mm for 3 to 4 kilo-volts. As soon as the optical pulse beam 11 appears, an electrical contact is established between the two electrodes 9 and 10 via the gallium arsenide semiconductor substrate 15. An avalanche-type phenomenon then occurs causing the commutator to close. These electrodes 9 and 10 are connected to the external circuits by the metallic connections 16 and 17 soldered to the sides 18 and 19 of the electrodes 9 and 10 using known techniques. The optical switching pulse 11 originates, for example, from an optical laser source emitting at wavelengths between 0.8 and 1.06 μm. In order to eliminate dielectric surface breakdown, a layer of approximately 5 to 10 μm of dielectric polymer, for example a polyimide, is applied to the surface of the commutator 8 containing the electrodes 9 and 10.

Figure 2A:
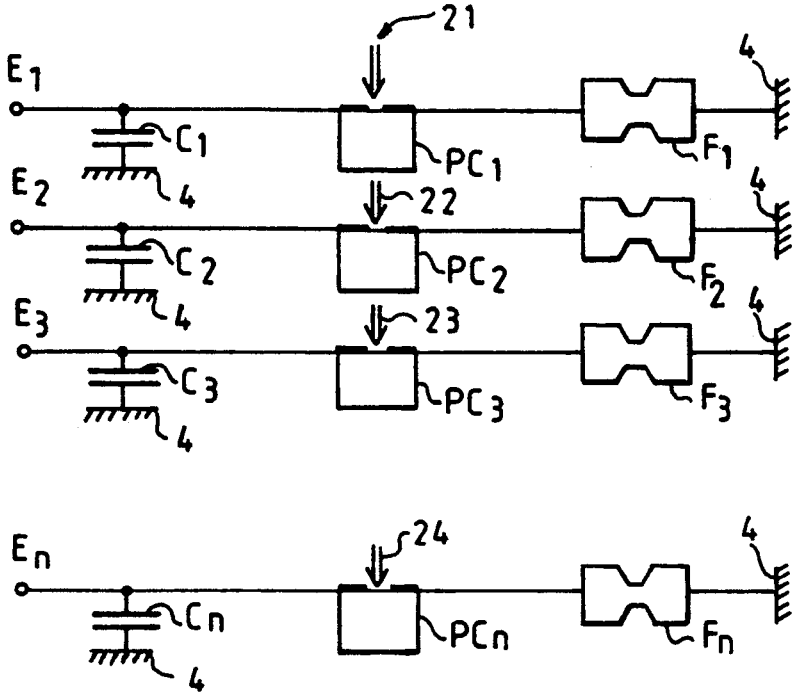
FIGS. 2*a*, 2*b*, 3, 4*a* and 4*b*: Multi-channel detonating devices according to the invention.

FIG. 2*a* presents a multi-channel detonating device according to the invention. It includes, for example, n elementary circuits of the same type as the one described in FIG. 1*a*. $E_1$, $E_2$, $E_3$ and $E_n$ are the energy inputs for the capacitors $C_1$, $C_2$, $C_3$ and $PC_1$. The energy stored in these capacitors is switched towards the detonators $F_1$, $F_2$, $F_3$ and $F_n$ via the gallium arsenide-based commutators $PC_1$, $PC_2$, $PC_3$ and $PC_n$ of the same type as the one in FIG. 1*b*. These commutators are controlled respectively by the optical pulse signals 21, 22, 23 and 24. The capacitors $C_1$, $C_2$, $C_3$ and $C_n$ and the detonators $F_1$, $F_2$, $F_3$ and $F_n$ each have one end connected to the same reference potential 4. The optical control pulse can be directed onto each of the commutators by several methods described below.

Figure 2B:
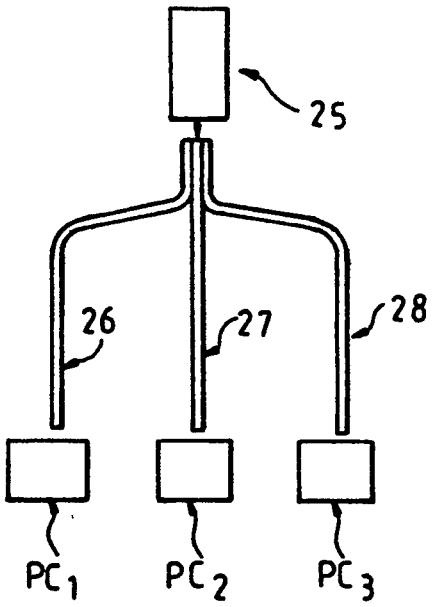

For a synchronous detonation method, one possible structure is presented in FIG. 2*b*. By way of example, the device comprises 3 detonating channels. A common optical source 25, a laser for example, sends synchronous pulses to the commutators $PC_1$, $PC_2$ and $PC_3$. These optical pulses are transmitted by the optical fibers 26, 27 and 28 of equal length. These optical fibers can be made of plastic or silicon, for example.

Figure 3:
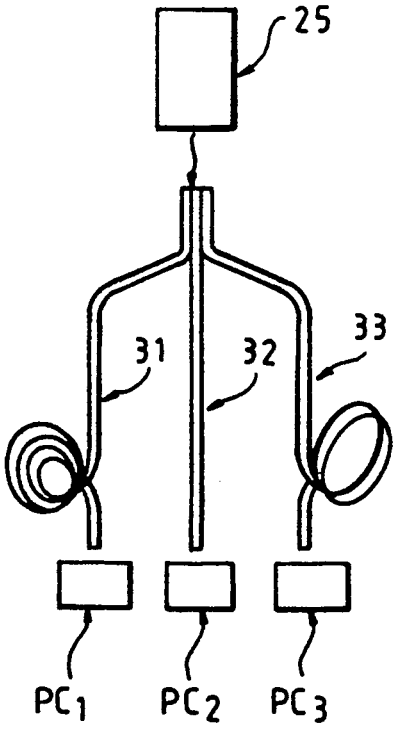

For a pre-programmed sequenced detonation method, one possible structure is presented in FIG. 3; it is identical to the structure in FIG. 2*b*, with the exception that the lengths of the optical fibers 31, 32 and 33 are not identical. For this operating mode, the length of each of the fibers 31, 32 and 33 is adapted to the timings needed between detonations. Generally, 1 meter of optical fiber causes a delay of approximately 3 ns; according to the nature of the optical fibers this delay can be precisely defined.

Figure 4A:
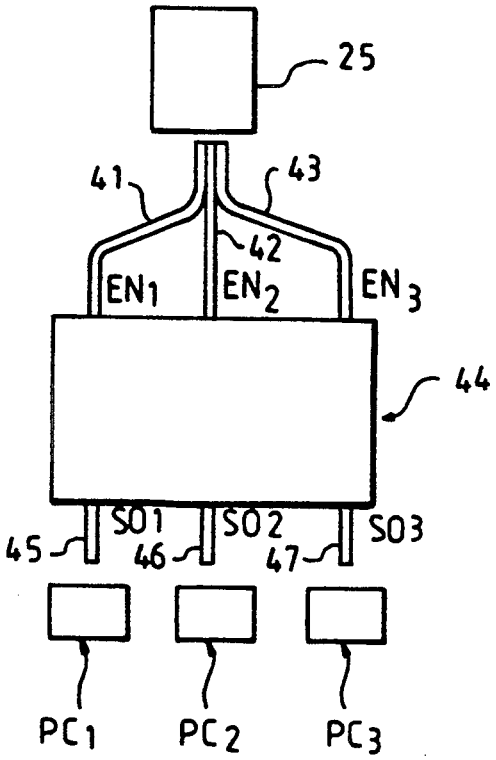
Figure 4B:
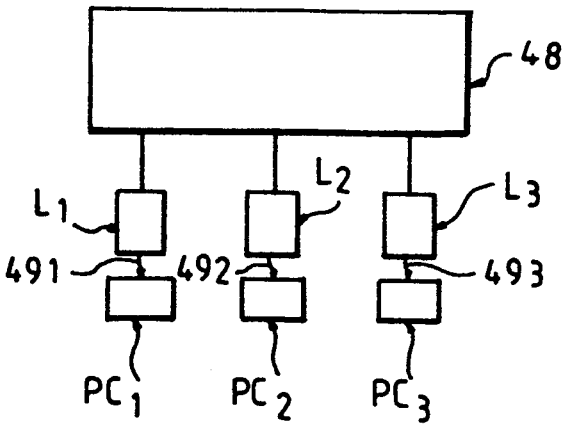

For a detonation method sequenced and programmed during the mission and adapted, for example, according to the target to be destroyed, two possible structures are presented in FIGS. 4*a* and 4*b*. The structure in 4*a* is made up of a common optical source 25, a laser for example. The optical fibers 41, 42 and 43 guide an optical pulse signal towards each of the inputs $EN_1$, $EN_2$ and $EN_3$ of an optical matrix 44. This optical matrix 44 is made up of a system of optical switches which can provide a certain number of pre-established sequences as a function of information received during the mission. At outputs $SO_1$, $SO_2$ and $SO_3$ of the matrix 44, three optical fibers 45, 46 and 47 of equal length guide the optical pulses to the commutators $PC_1$, $PC_2$ and $PC_3$. The Aérospatiale publication "4ème Congrès International de Pyrotechnie Spatiale" concerning the conference organized by the Groupe Technique de Pyrotechnie Spatiale (GPTS) on Jun. 5 to 9, 1989, pages 207 to 213, indicates a certain number of optical switching methods for obtaining the sequences mentioned above.

FIG. 4*b* presents a possible structure where there are as many laser optical sources $L_1$, $L_2$ and $L_3$ as there are commutators $PC_1$, $PC_2$ and $PC_3$. These laser sources are triggered according to programmable sequences by the electronic control circuits 48 the fabrication of which is known to those skilled in the art. The lasers $L_1$, $L_2$ and $L_3$ emit respectively optical pulses 491, 492 and 493 towards the commutators $PC_1$, $PC_2$ and $PC_3$.

Figure 5A:
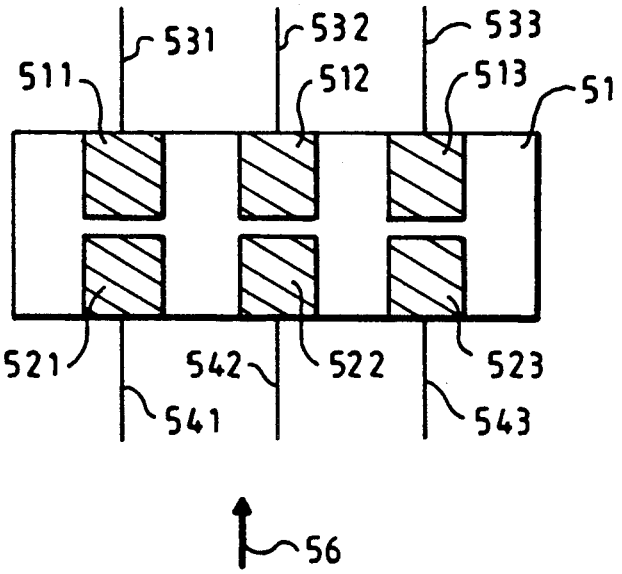
FIGS. 5*a*, 5*b*, 6*a* and 6*b*: Possible structures containing several energy commutators for the detonating devices according to the invention.
Figure 5B:
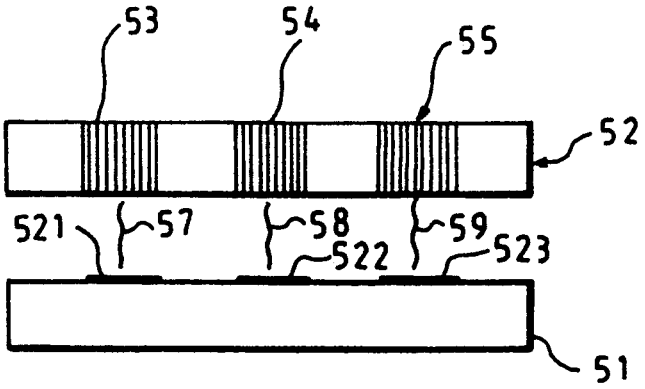

FIGS. 5*a* and 5*b* present a possible structure containing several energy commutators and designed to be used, for example, in the multi-channel detonation devices described in FIGS. 2*a* and 4*b*.

FIG. 5*a* represents a plan view of a semiconducting substrate 51, of gallium arsenide for example, on which is placed a network of metal electrodes 511, 512, 513, 521, 522 and 523 forming three commutators, the electrodes 511 and 521 forming a first commutator linked at the input to a line 531 and at the output to a line 541. The electrodes 512 and 522 form a second commutator linked at the input to a line 532 and at the output to a line 542, and the electrodes 513 and 523 form a third commutator linked at the input to a line 533 and at the output to a line 543. The geometric parameters of the electrodes are determined by the electrical constraints of the firing circuits, in particular as regards current, voltage and switching time. three commutators are represented in FIG. 5*a*, but obviously it is possible to create more, in fact as many as there are detonation lines.

FIG. 5*b* shows a view of the semiconductor substrate 51 of FIG. 5*a* carrying the electrodes 511, 512, 513, 521, 522 and 523, viewed in the direction of the arrow 56 of FIG. 5*a*. The commutators are placed opposite the network 53, 54 and 55 of laser diodes mounted on the bar 52 and capable of emitting optical pulses 57, 58 and 59 in order to trigger the commutators. Each of the networks can be controlled separately by an associated electronic control the fabrication of which is known to those skilled in the art, which assures a synchronous or sequenced detonation depending on the application. This structure presented in FIGS. 5*a* and 5*b* has the advantage of being compact and easily adapted to a wide range of detonation methods.

Figure 6A:
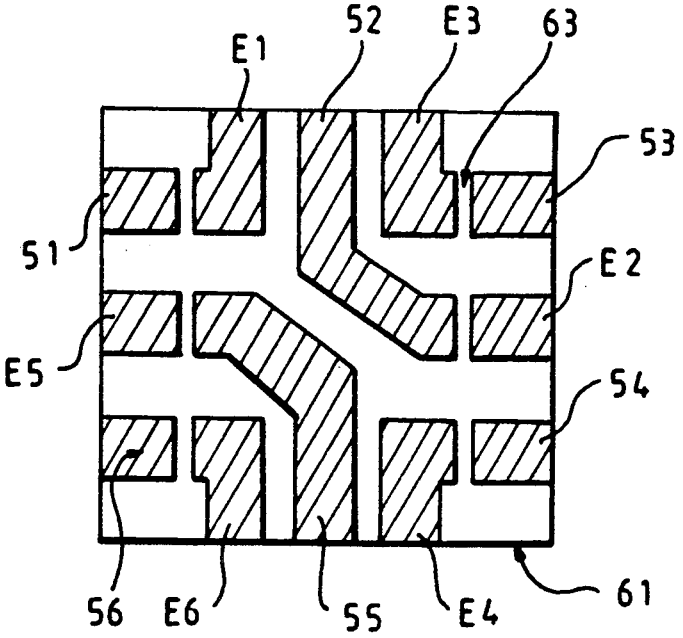
Figure 6B:
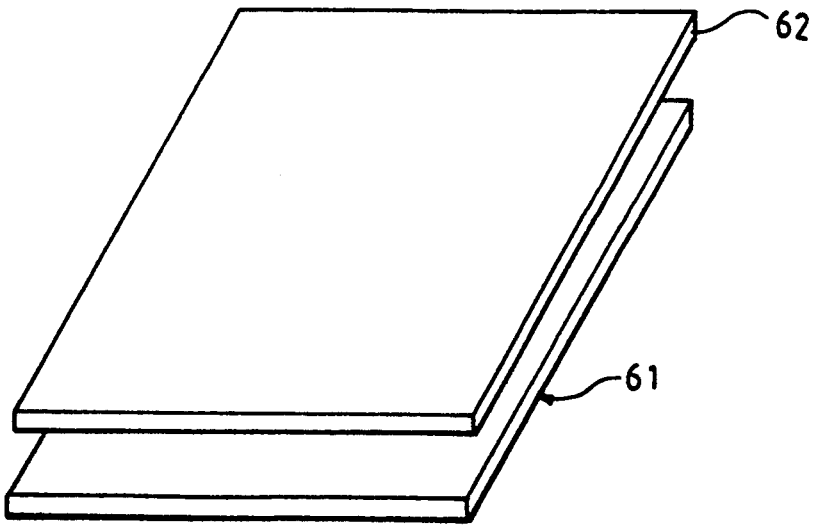

Nevertheless, if the number of commutators is very large, the structure presented in FIGS. 6*a* and 6*b* would be more suitable as it is more compact. FIG. 6*a* represents a network of six commutators intended for use with a detonating device according to the invention and placed on a gallium arsenide semiconductor substrate 61. Six comtutators are formed respectively by electrodes $E_1$ and $S_1$, $E_2$ and $S_2$, $E_3$ and $S_3$, $E_4$ and $S_4$, $E_5$ and $S_5$ and $E_6$ and $S_6$. A distance 63 between the electrodes of a commutator is a function of the tension applied across the contacts of the commutator.

FIG. 6*b* presents the substrate semiconductor 61 of the commutators placed opposite a group of laser diode networks, themselves placed on a support 62. These laser diode networks activate the commutators placed on the semiconductor substrate by their optical pulses. The group of laser diode networks on the support 62 can be obtained by stacking bars similar to the bar 52 in FIG. 5*b*. It can also, for example, be in the form of surface emission networks. The fabrication of the commutators on the semiconductor substrate 61 calls for microelectronic techniques known to those skilled in the art.

Figure 7A:
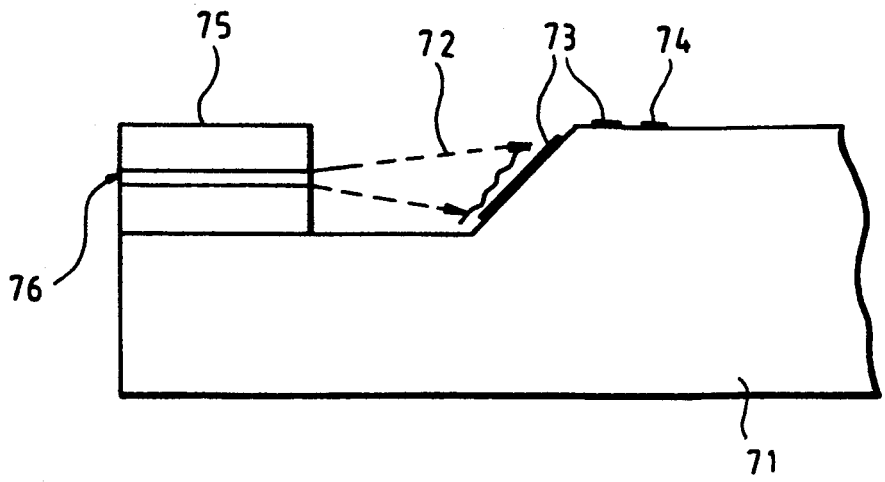
FIGS. 7*a* and 7*b*: A compact structure containing several energy commutators for the detonating devices according to the invention.
Figure 7B:
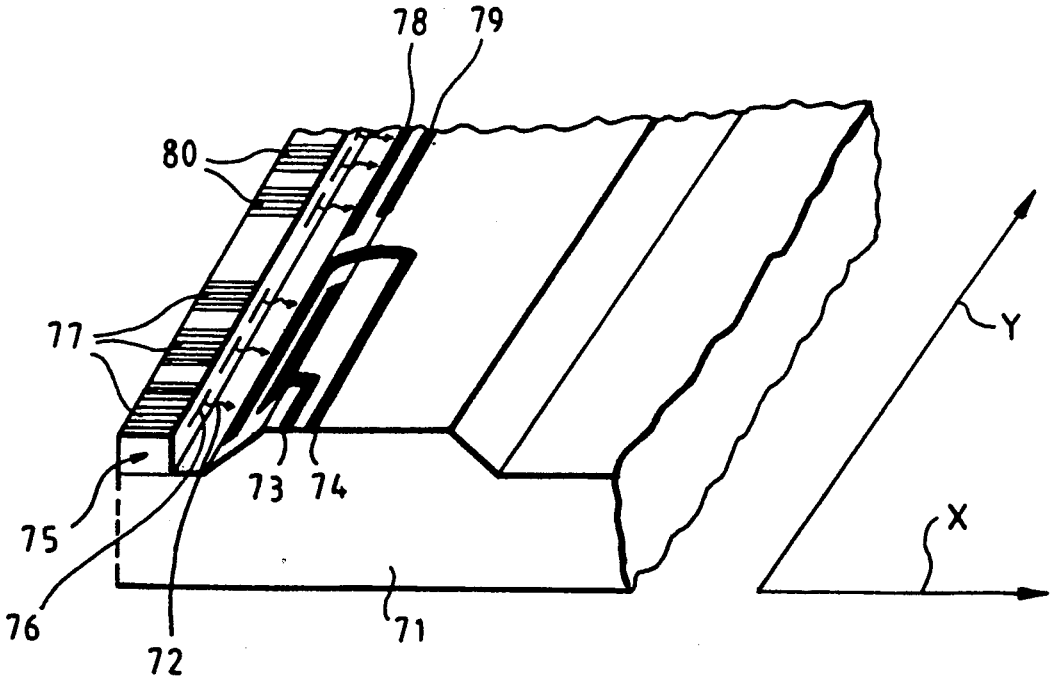

FIGS. 7*a* and 7*b* present a monolithic structure of a group of commutators and their optical sources intended for use with a device according to the invention. FIG. 7*a* represents a sectional view of FIG. 7*b*. FIG. 7*b* shows only two commutators made up of, respectively, electrodes 73 and 74 and their associated laser diode networks 77, and electrodes 78 and 79 and their associated laser diode networks 80. These electrodes, placed on a gallium arsenide semiconductor substrate 71, are situated in a plane inclined at 45° with respect to the optical emission 72 delivered by the laser diode networks 77 and 80 at the exit layers 76. These laser diode networks 77 and 80 are fixed on a bar 75 which is fixed to the semiconductor substrate 71. The structure presented in FIGS. 7*a* and 7*b* can be enlarged along X and Y axes parallel to the sides of the substrate 71 by repeating the same units represented by these two figures. This structure has the advantage of being very compact and mechanically strong. What is more, it optimizes the optical coupling, therefore increasing the yield and the reproducibility, between the laser source and the commutator.

Finally, it is possible to completely integrate on a silicon substrate an electronic control unit and working and program memories. Then, by epitaxy of gallium arsenide onto the silicon, it is possible to integrate the structure described in FIGS. 7*a* and 7*b* with an electronic control. Maximum compactness can be obtained by metallization of the electrical circuits linking the energy reservoirs to the detonators, in the form of three-layer lines of adapted impedance.

What is claimed is:

1. A detonating device for a secondary explosive charge, comprising:

optical pulse beam source means; and at least one detonation channel, each one of said at least one detonation channels including energy reservoir means and exploding foil igniter means coupled to said energy reservoir means via optical energy switching means, wherein said optical energy switching means consists of a gallium arsenide commutator comprising a pair of metal electrodes spaced apart and positioned on a surface of a gallium arsenide semiconductor substrate such that an electrical connection is established between said pair of metal electrodes via said gallium arsenide substrate upon the impingement of an optical pulse beam, generated by said optical pulse beam source means, on said optical energy switching means, and such that when said optical pulse beam ceases to impinge on said optical energy switching means, said electrical connection is maintained until all energy stored in said energy reservoir means has been discharged therethrough.

2. A detonating device according to claim 1, wherein said electrical connection is established for each one of said at least one detonation channels when optical pulse beams generated by a single optical pulse beam source and guided by separate optical fibers of equal length impinge upon said optical switching means of each corresponding one of said at least one detonation channels.

3. A detonating device according to claim 1, wherein said electrical connection is established for each one of said at least one detonation channels when optical pulse beams generated by a single optical pulse beam source and guided by optical fibers impinge upon said optical switching means of each corresponding one of said at least one detonation channels, the length of each one of said optical fibers being dependent upon a predetermined detonation timing sequence of said detonating device.

4. A detonating device according to claim 1, said detonating device further comprising an optical matrix including an optical switching system which provides preprogrammed detonation timing sequences as a function of memorized information, wherein said optical matrix receives optical pulse beams generated by said optical pulse beam source means and guided by separate optical fibers and outputs optical beam pulses in a preprogrammed detonation timing sequence which are subsequently guided via optical fibers of equal length so as to impinge upon said optical energy switching means of each one of said at least one detonation channels.

5. A detonating device according to claim 1, wherein each of said optical energy switching means of each one of said at least one detonation channels receives optical pulse beams that are generated in preprogrammed detonation timing sequences by separate optical pulse beam sources, each one of said separate optical pulse beam sources being dedicated to each corresponding one of said at least one detonation channels.

6. A detonating device according to claim 1, wherein said optical energy switching means of each one of said at least one detonation channels are all formed on a single semiconductor substrate.

7. A detonating device according to claim 1, wherein said optical pulse beam source means comprises a series of laser diode networks mounted on a bar.

8. A detonating device according to claim 7, wherein said metal electrodes of each one of said optical energy switching means are positioned on a gallium arsenide semiconductor substrate such that an acute angle exists between the directional orientation of a plane in which surfaces of said metal electrodes are situated and the direction of propagation of optical pulse beams emitted by said laser diode networks.

* * * * *